United States Patent [19]

Haavik

[11] 4,334,830

[45] Jun. 15, 1982

[54] TWO-STAGE LIQUID RING PUMP WITH IMPROVED INTRASTAGE AND INTERSTAGE SEALING MEANS

[75] Inventor: Harold K. Haavik, South Norwalk, Conn.

[73] Assignee: The Nash Engineering Company, Norwalk, Conn.

[21] Appl. No.: 133,628

[22] Filed: Mar. 24, 1980

[51] Int. Cl.[3] ..... F04C 19/00

[52] U.S. Cl. ..... 417/68; 417/244

[58] Field of Search ..... 417/68, 69, 244; 418/142, 144

[56] References Cited

U.S. PATENT DOCUMENTS

| | | | |
|---|---|---|---|
| 367,207 | 7/1887 | Hughes . | |
| 1,879,988 | 9/1932 | Morton et al. . | |
| 2,021,346 | 11/1935 | Allen . | |
| 2,190,670 | 2/1940 | Mann . | |
| 2,228,841 | 1/1941 | Norton . | |
| 2,331,641 | 10/1943 | Walker . | |
| 2,416,538 | 2/1947 | Nelson . | |
| 2,707,388 | 5/1955 | Kent . | |
| 2,761,748 | 9/1956 | Marien . | |
| 3,185,386 | 5/1965 | Peras | 418/144 X |
| 3,197,126 | 7/1965 | Jungbluth | 418/144 X |
| 3,228,587 | 1/1966 | Segebrecht | 417/68 X |
| 3,289,918 | 12/1966 | Adams . | |
| 3,306,620 | 2/1967 | Taschenberg . | |
| 3,348,766 | 10/1967 | Mugele . | |
| 3,552,753 | 1/1971 | Mierley . | |
| 3,588,283 | 6/1971 | Fitch . | |
| 3,612,545 | 10/1971 | Storms . | |
| 3,743,443 | 7/1973 | Jennings . | |
| 3,754,834 | 8/1973 | Wolters . | |
| 3,846,046 | 11/1974 | Roe et al. | 417/68 X |
| 3,976,407 | 8/1976 | Gerlach | 418/144 X |

FOREIGN PATENT DOCUMENTS

| | | | |
|---|---|---|---|
| 569547 | 1/1924 | France | 417/68 |
| 1500200 | 2/1978 | United Kingdom . | |

*Primary Examiner*—Carlton R. Croyle
*Assistant Examiner*—Edward Look
*Attorney, Agent, or Firm*—Robert R. Jackson; John A. Howson

[57] ABSTRACT

In a two-stage liquid ring pump, gas leakage from the high pressure to the low pressure side of at least the first stage is substantially reduced and gas leakage from the second stage to the first stage is substantially reduced or eliminated by providing an annular seal member in the clearance between the first stage port plate adjacent the second stage and the adjacent end of the first stage rotor hub and supplying sealing liquid under pressure at least equal to the pump discharge pressure to substantially fill the portion of the clearance bounded by the annular seal member.

9 Claims, 3 Drawing Figures

TWO-STAGE LIQUID RING PUMP WITH IMPROVED INTRASTAGE AND INTERSTAGE SEALING MEANS

BACKGROUND OF THE INVENTION

This invention relates to liquid ring pumps, and more particularly to improved intrastage and interstage seals for two-stage liquid ring pumps.

Two-stage liquid ring pumps are shown for example in Fitch U.S. Pat. No. 4,132,504, entitled "Liquid Ring Pump." Pumps of this kind typically include axially adjacent first and second stages. Each stage includes a cylindrical housing having a port plate on at least one end of the housing. Each port plate has separate gas intake and discharge ports. (It will be understood that the term "gas" as used herein includes vapor. Also, although various arrangements of intake and discharge ports may be used, it will be assumed for convenience herein that each port plate has only one intake port and one discharge port.) In the pumps of particular interest to the present invention, each stage includes such a port plate on at least the end of the housing adjacent the other stage. Pumps of this type are known as center head pumps, and the two adjacent port plates (one in each of the two stages of the pump) are sometimes referred to for convenience herein as center port plates. A rotor is eccentrically mounted for rotation in the housing for each stage. Each rotor includes a plurality of blades extending radially outward from a hub. The hubs of both rotors are mounted on a common shaft which extends through the center port plates. A quantity of pumping liquid (e.g., water) is also present in each stage.

In operation, the common shaft is rotated to rotate the rotors and thereby produce a ring of circulating pumping liquid in each stage. Because each rotor is mounted eccentrically in its housing, the rotor blades cooperate with the pumping liquid in each stage to form pumping chambers between adjacent blades which cyclically expand and contract as the rotor rotates. The intake port of each stage communicates with the expanding pumping chambers, while the discharge port communicates with the contracting chambers. Accordingly, gas is drawn into each stage via the intake port at a relatively low pressure and is discharged from that stage via the discharge port at a higher pressure. The discharge port of the first stage is connected to the intake port of the second stage so that the first stage discharge pressure is further increased by operation of the second stage, i.e., the second stage discharge pressure is higher than the first stage discharge pressure.

In liquid ring pumps it is generally desirable to increase the volumetric efficiency of the pump by reducing the leakage of gas from the higher pressure zones in the pump to the lower pressure zones. In two-stage pumps of the center head type this leakage is typically of two kinds: intrastage leakage from the higher pressure side of each stage to the lower pressure side of that stage, and interstage leakage from the second stage to the first stage. Intrastage leakage chiefly occurs at the end of the rotor hub adjacent a port plate. Interstage leakage chiefly occurs along the shaft extending between the intrastage leakage sites described above.

Both intrastage and interstage leakage can be reduced by building the pump with small clearances between the hub ends and the adjacent port plates and with small clearances for the interstage portion of the shaft. However, such small clearances substantially increase the manufacturing cost of the pump and are unlikely to be completely effective in eliminating leakage.

To reduce intrastage leakage it is known to introduce a flow of sealing liquid (generally the same as the pumping liquid) into the clearance between the port plate and the adjacent hub end. This, however, may have several disadvantages and shortcomings. First, a relatively large flow of such sealing liquid may be required to attempt to substantially fill the clearance. Second, the sealing liquid has a strong tendency to flow only toward the low pressure side of the pump which may allow intermittent failure of the seal. Third, and especially important in the first stage of two-stage pumps pumping gas which is initially less than fully saturated with vapor of the sealing liquid, the strong flow of sealing liquid toward the low pressure side of the pump typically introduces a spray of sealing liquid into the gas as it enters the pump via the intake port. This is highly conducive to saturating the intake gas with sealing liquid vapor before the gas has been significantly compressed by the pump, thereby reducing the volumetric efficiency of the pump.

Many of these shortcomings of intrastage liquid seals are aggravated in two-stage pumps of the center-head type by the possibility of interstage leakage.

In view of the foregoing, it is an object of this invention to improve and simplify two-stage liquid ring pumps of the center head type.

It is a more particular object of this invention to increase volumetric efficiency and reduce both intrastage and interstage gas leakage in two-stage liquid ring pumps of the center head type.

SUMMARY OF THE INVENTION

These and other objects of the invention are accomplished in accordance with the principles of the invention by providing in a two-stage liquid ring pump of the type described above an annular seal member at least in the clearance between the first stage center port plate and the adjacent first stage rotor hub end, the annular seal member surrounding the shaft and being radially spaced therefrom, and supplying a flow of sealing liquid at a pressure at least equal to the second stage discharge pressure to substantially fill at least the portion of the clearance bounded by the annular seal member. The annular seal member substantially confines the sealing liquid in the portion of the clearance bounded by it, thereby cooperating with the sealing liquid to produce a more stable and effective seal. This seal greatly reduces intrastage leakage in the first stage and substantially eliminates interstage leakage, thereby significantly improving the volumetric efficiency of the pump. In addition, the presence of the annular seal member greatly reduces the flow of sealing liquid into the first stage of the pump, and particularly into the gas entering the pump, thereby further increasing the volumetric efficiency of the pump when pumping initially unsaturated gas. The slow release of pressurized sealing liquid by the annular seal member cools and lubricates the seal member and extends its life.

Preferably, the clearance between the first stage center port plate and the adjacent first stage rotor hub end communicates with a clearance surrounding the interstage portion of the shaft and with a clearance between the second stage center port plate and the adjacent second stage rotor hub end so that a portion of the sealing fluid flows into the second stage to provide an intrastage seal in that stage. If desired, a second annular seal member can be provided in the second stage in a manner similar to the first stage annular seal member to enhance the second stage intrastage seal.

Further features of the invention, its nature and various advantages will be more apparent from the accompanying drawing and the following detailed description of the invention.

DETAILED DESCRIPTION OF THE INVENTION

Figure 1:
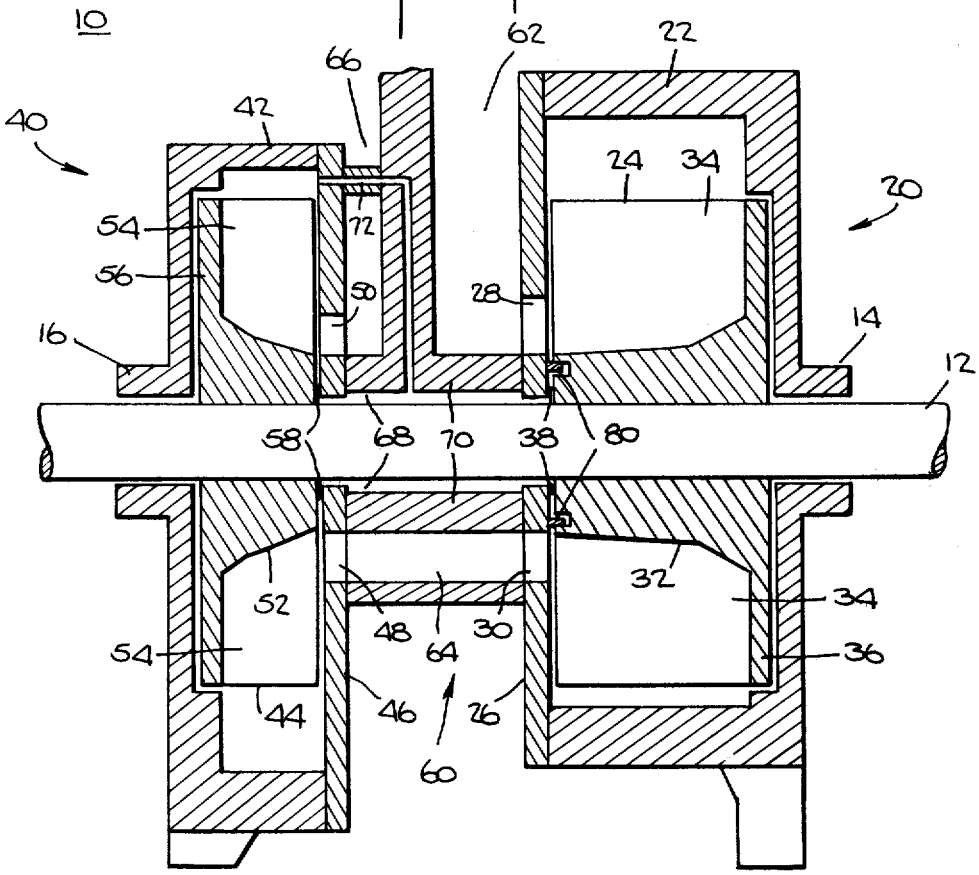
FIG. 1 is a greatly simplified, partly schematic, longitudinal cross sectional view of a two-stage liquid ring pump of the center head type constructed in accordance with the principles of this invention.

As shown in FIG. 1, a two-stage liquid ring pump 10 of the center head type includes axially adjacent first and second stages 20 and 40, respectively, which are connected to one another by intermediate center head assembly 60. Each stage respectively includes a cylindrical housing 22, 42 and a rotor 24, 44 eccentrically mounted for rotation on a common drive shaft 12 extending through both stages and through center head assembly 60. The opposite ends 14 and 16 of the pump housing are sealed to shaft 12 by conventional mechanical shaft seals or packing glands (not shown).

The housing for each stage includes a port plate 26 or 46, respectively, on the side of the housing adjacent center head assembly 60. Center head assembly 60 includes pump intake conduit 62, interstage conduit 64, pump discharge conduit 66, and sealing liquid conduit 72. Each port plate respectively includes an intake port 28, 48 and a discharge port 30, 50. Each intake port admits gas at a relatively low pressure to the associated stage wherein the gas is compressed and discharged at a higher pressure via the discharge port for that stage.

Each rotor respectively includes an annular hub 32, 52, a plurality of rotor blades 34, 54 extending radially from the hub, and a flange 36, 56 also extending radially from the end of the hub remote from the associated port plate and lying in a plane perpendicular to both shaft 12 and the associated rotor blades 34 or 54. A quantity of pumping liquid (not shown) is included in each stage so that when the rotor in that stage rotates, the pumping liquid forms a ring around the inside of the associated housing in the manner well known for liquid ring pumps. As is conventional in liquid ring pumps, means (not shown) are typically provided for regulating the quantity of pumping liquid in each stage, as well as for cooling and otherwise treating that liquid.

The gas to be pumped is supplied to first stage intake port 28 via pump intake conduit 62. The gas is partly compressed in first stage 20 and then passed to second stage intake port 48 via interstage conduit 64. The gas is further compressed in second stage 40 and finally discharged from the pump via second stage discharge port 50 and pump discharge conduit 66.

As is typical in such pumps, there is an annular clearance 38 and 58, respectively, between the central portion of port plate 26, 46 and the adjacent end of rotor hub 32, 52. (It will be understood that these and other clearances are greatly exaggerated for clarity in the drawing.) There is also an annular clearance 68 between the interstage portion of shaft 12 and the surrounding portion 70 of center head assembly 60. Although efforts may be made in some prior art pumps to isolate clearances 38 and 58 from one another to prevent interstage leakage, this is not necessary in the pumps of this invention, and in the preferred embodiment of these pumps, clearances 38, 58, and 68 are all communicating.

In accordance with this invention, leakage of gas from the high pressure side of first stage 20 adjacent discharge port 30 to the low pressure side of that stage adjacent intake port 28 (so-called first stage intrastage leakage), as well as leakage of gas from higher pressure second stage 40 to lower pressure first stage 20 (so-called interstage leakage), are substantially reduced or prevented by annular seal member 80 in clearance 38 in cooperation with a suitable supply of pressurized sealing liquid supplied to clearance 38 inside seal member 80.

Figure 2:
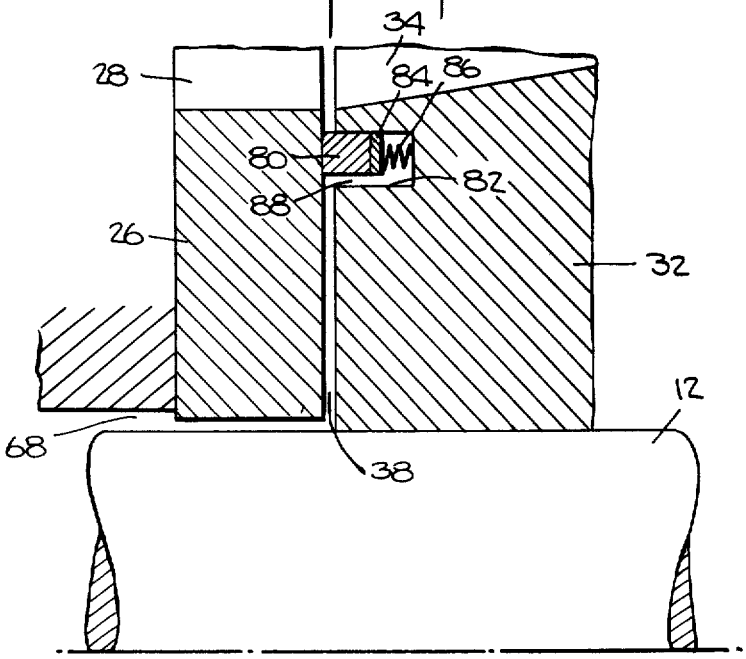
FIG. 2 is a detailed view of a portion of the apparatus shown in FIG. 1.

As shown in FIGS. 1 and 2, annular seal member 80 surrounds shaft 12 and is radially spaced therefrom. Seal member 80 is in sealing contact or engagement with port plate 26 and the adjacent end of rotor hub 32. Seal member 80 is preferably located radially as far from shaft 12 as the circumference of hub 32 will permit in order to seal as much as possible of the open end of rotor 24.

In the particular embodiment shown in FIGS. 1 and 2, annular seal member 80 is mounted in an annular slot 82 in the end of rotor hub 32 and bears on the adjacent inside surface of port plate 26. Alternatively, seal member 80 could be mounted in a slot on the inside surface of port plate 26 so as to bear on the adjacent surface of the end of rotor hub 32. Seal member 80 is preferably an inert, low friction material which is long wearing and compatible with the adjacent pump materials and with the liquids and gases to which it is exposed. Suitable materials include carbon, polytetrafluroethylene (Teflon), and the like. Although seal member 80 is preferably undivided, it could be cut or segmented, provided the gaps between the segments are relatively small.

Behind seal member 80 in slot 82 is an annular shim 84 and means 86 for resiliently biasing seal member 80 outward in slot 82. Resilient biasing means 86 is typically some form of compression spring, preferably an annular compression wave spring. Alternatively, resilient biasing means 86 may be hydraulic, e.g, one or more conduits through rotor hub 32 from the radially inward portion of clearance 38 to the bottom of slot 82 for applying sealing liquid pressure (described in greater detail below) to the rear surface of seal member 80 via shim 84. Shim 84 helps to more uniformly distribute to seal member 80 the possibly nonuniform force of resilient biasing means 86.

Sealing member 80 and associated elements are relatively free to move into and out of slot 82 (i.e., left and right as viewed in FIGS. 1 and 2). On the other hand, seal member 80 preferably has good sealing contact with the slotted element. This is preferably accomplished by providing a line-to-line contact between one side of slot 82 (preferably the radially outward side as shown in the drawing) and the adjacent side of seal member 80, while leaving a clearance 88 between the other side of the slot and the seal member.

Slot 82 and seal elements 80, 84, and 86 are preferably designed so that resilient biasing means 86 reaches full extension before seal member 80 is completely worn away or loses sealing contact with the side of slot 82. It has been found that even when pressure on seal member 80 from biasing means 86 is essentially zero, sealing member 80 continues to function effectively as described herein and with extremely long life because the wear rate is then very low.

As mentioned above, sealing liquid is supplied under pressure to clearance 38 inside seal member 80. The flow of sealing liquid is preferably sufficient to keep the portion of clearance 38 which is bounded or surrounded by seal member 80 substantially filled with sealing liquid. The pressure of the sealing liquid is at least equal to the final discharge pressure of the pump, and preferably somewhat higher than that discharge pressure, e.g., 5 to 20 p.s.i. higher than that discharge pressure. The sealing liquid may be any suitable liquid (e.g., water) and is typically the same as the pumping liquid in the pump.

In the preferred embodiment shown in the drawing, the source of sealing liquid is the pumping liquid on the high pressure side of second stage 40. Preferably, a portion of this pumping liquid is withdrawn via conduit 72 at a point where the liquid pressure is somewhat higher (e.g., 5 to 20 p.s.i. higher) than the final discharge pressure of the pump. Conduit 72 conducts the withdrawn pumping liquid (now sealing liquid) to clearance 68 where a portion of it flows into communicating clearance 38 inside annular seal member 80. Although a small amount of sealing liquid typically escapes from clearance 38 past seal member 80, this flow is much smaller than it would be in the absence of the seal member. Accordingly, the first stage seal consumes much less sealing liquid than it otherwise would, and unsaturated gas entering the first stage is not saturated by a large spray of sealing liquid into the gas adjacent intake port 28. This significantly improves the volumetric efficiency of the pump when pumping initially unsaturated gas. The small amount of sealing liquid which does pass seal member 80 advantageously cools and lubricates the seal member, thereby prolonging its life.

Seal member 80 and the annulus of pressurized sealing liquid confined and stabilized in clearance 38 between seal member 80 and shaft 12 substantially prevent first stage intrastage leakage in the area bounded by seal member 80. In addition, this seal member and sealing liquid effectively eliminate interstage leakage from the second stage to the first stage.

In the preferred embodiment shown in FIG. 1, a portion of the sealing liquid supplied to clearance 68 via conduit 72 is used to reduce intrastage leakage in second stage 40. Thus a portion of the sealing liquid supplied to clearance 68 flows into communicating clearance 58 where it helps prevent intrastage leakage around the open end of second stage rotor 44. If desired, an annular seal member and associated elements similar to seal member 80 and its associated elements can be provided in clearance 58 to enhance this second stage intrastage seal.

Although in the preferred embodiment shown in FIG. 1 the sealing liquid supply is the second stage pumping liquid, the pressurized sealing liquid can alternatively be supplied from any other suitable source.

Figure 3:
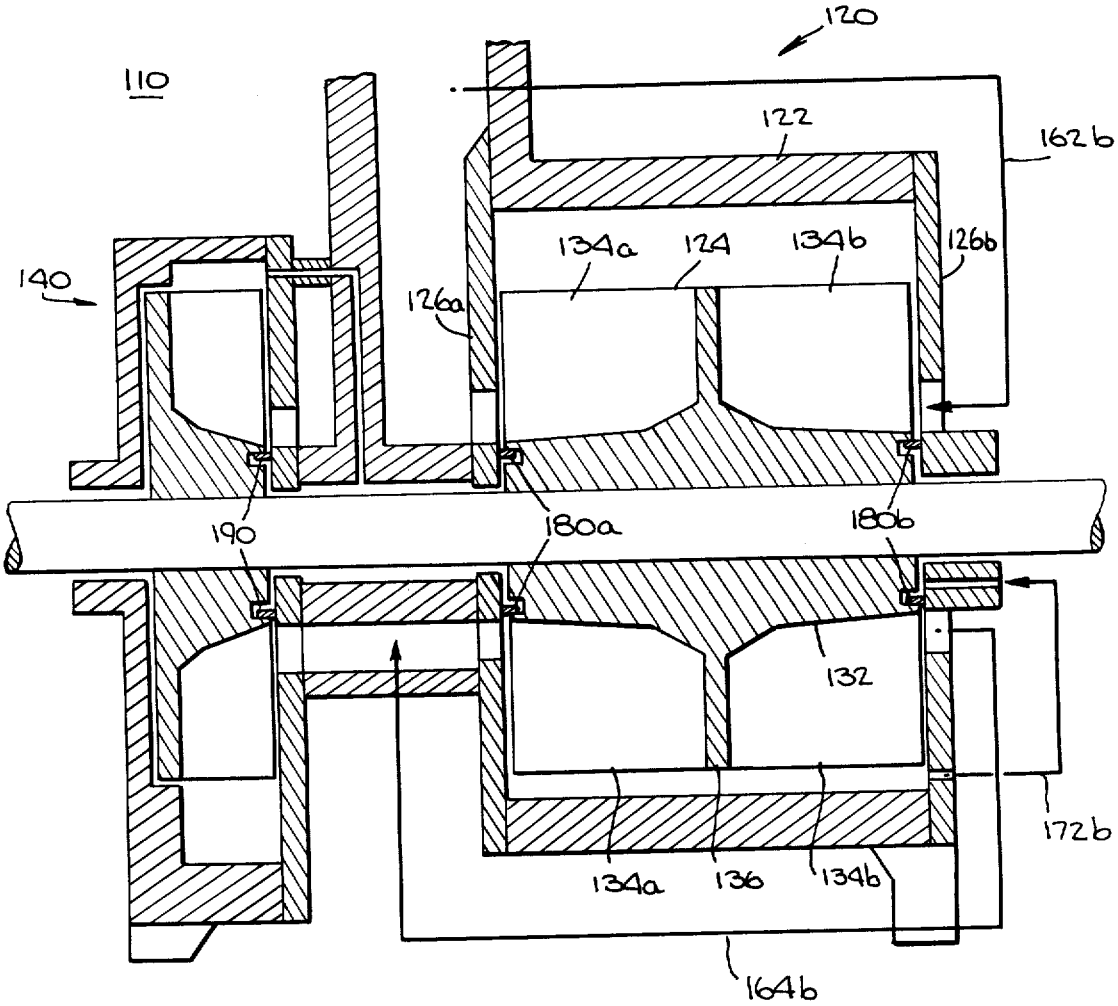
FIG. 3 is a view similar to FIG. 1 showing a pump similar to that shown in FIG. 1 but having a double-ended rather than a single-ended first stage.

FIG. 3 shows a two-stage liquid ring pump 110 of the center head type constructed in accordance with the principles of this invention in which the first stage 120 is double-ended rather than single-ended as in the pump of FIG. 1. The second stage 140 of pump 110 also has an annular seal member 190 similar to seal member 80 in FIG. 1 as part of a second stage intrastage seal. In other respects, second stage 140 is similar to second stage 40 in pump 10.

The left-hand portion of first stage 120 is also basically similar to first stage 20 in pump 10. In addition, however, first stage 120 has a right-hand portion which is a mirror image of the left-hand portion. Thus first stage housing 122 has a port plate **126*a* or 126*b* on each end. Similarly, first stage rotor 124 includes hub 132 and a plurality of radially extending blades 134*a* and 134*b* separated by radially extending flanges 136. The two portions of first stage 120 operate in parallel, with a portion of the gas to be pumped being conveyed to the right-hand portion of the first stage via conduit 162*b*, and the gas discharged from that portion of the first stage being conveyed to the second stage via conduit 164*b***.

The left-hand portion of first stage 120 includes annular seal member **180*a*, similar to seal member 80 in FIGS. 1 and 2 and similarly supplied with pressurized sealing liquid from the second stage pumping liquid. A second similar annular seal member 180*b* and associated elements are provided at the other end of first stage rotor hub 132. Pressurized sealing liquid is also supplied to the annular clearance bounded by seal member 180*b*. This sealing liquid substantially fills the clearance bounded by seal member 180*b* and cooperates with that seal member to provide a highly effective intrastage seal at the second end of the first stage rotor hub. The pressure of this sealing liquid may, if desired, be somewhat lower than is preferred for the sealing liquid at the other end of the first stage rotor because this second end of the rotor is subject only to intrastage and not interstage leakage. Thus the pressure of this second sealing liquid is at least equal to the discharge pressure of the first stage, preferably several p.s.i. higher than that pressure. Although the source of this second sealing liquid may be the same as the first (i.e., the second stage pumping liquid or another suitable source), in the particular embodiment shown in FIG. 3 a portion of the first stage pumping liquid is withdrawn from the compression side of first stage 120 and supplied as this sealing liquid via conduit 172*b***.

Although the invention has been illustratively described in its application to pumps having flat port plates, it will be apparent to those skilled in the art that the invention is also applicable to pumps having port plates with other shapes, e.g., conical and cylindrical port plates.

It is to be understood that the foregoing is illustrative of the principles of the invention only, and that various modifications can be implemented by those skilled in the art without departing from the scope and spirit of the invention. For example, various means can be used to resiliently bias the annular seal member in its slot as described above.

I claim:

1. In a two-stage liquid ring pump of the center head type, the pump including (1) first and second stages each having (a) a cylindrical housing, (b) a rotor eccentrically mounted for rotation in the housing, and (c) a port plate on the end of the housing adjacent the other stage, each port plate having an intake port and a discharge port, the first stage discharge port being connected to the second stage intake port, both of the rotors being mounted on a common shaft which extends through both of the port plates, the portion of the shaft intermediate the port plates passing through and being enclosed by an interstage housing structure which extends between the port plates, each rotor including an annular hub and a plurality of radially extending circumferentially spaced blades, (2) a first annular clearance extending radially outward from the shaft between the first stage port plate and the adjacent end of the first stage rotor hub and communicating with the interior of the interstage housing structure adjacent the shaft, and (3) a second annular clearance extending radially outward from the shaft between the second stage port plate and the adjacent end of the second stage rotor hub and communicating with the interior of the interstage housing structure adjacent the shaft, improved gas sealing means comprising:

an annular seal member disposed in the first annular clearance, the annular seal member surrounding the shaft and being radially spaced therefrom to define an enclosed portion of the first annular clearance; and means for supplying pressurized sealing liquid to the enclosed portion of the first annular clearance to substantially fill the enclosed portion with pressurized sealing liquid, the pressure of the sealing liquid being at least equal to the final discharge pressure of the pump, the annular seal member and the pressurized sealing liquid in the enclosed portion cooperating to substantially prevent gas leakage through the enclosed portion from the high pressure side of the first stage to the low pressure side of the first stage, and also substantially preventing gas leakage from the second stage to the first stage via the second annular clearance, the interior of the interstage housing structure, and the first annular clearance.

2. The apparatus defined in claim 1 wherein the annular seal member is mounted in a slot in either the first stage port plate or the first stage rotor hub.

3. The apparatus defined in claim 2 further comprising:

means for resiliently biasing the annular seal member outwardly of the slot.

4. The apparatus defined in claim 3 wherein a portion of the annular seal member remains in the slot even when the means for resiliently biasing the annular seal member is fully extended.

5. The apparatus defined in claim 2 wherein an annular portion of one side surface of the annular seal member is in sealing contact with an annular portion of one side of the slot.

6. The apparatus as defined in claim 5 wherein the sides of the annular seal member and the slot which are in sealing contact are the radially outermost sides.

7. In a two-stage liquid ring pump of the center head type, the pump including (1) first and second stages each having (a) a cylindrical housing including a port plate on the side of the housing adjacent the other stage, each port plate having an intake port and a discharge port, the first stage discharge port being connected to the second stage intake port, (b) a rotor eccentrically mounted for rotation in the housing, both rotors being mounted on a common shaft which extends through both port plates, each rotor including an annular hub and a plurality of radially extending circumferentially spaced blades, and (c) a quantity of liquid maintained in a ring inside the outer periphery of the housing by rotation of the rotor in the housing, and (2) a first annular clearance extending radially outward from the shaft between the first stage port plate and the adjacent end of the first stage rotor hub, improved gas sealing means comprising:

an annular seal member disposed in the first annular clearance, the annular seal member surrounding the shaft and being radially spaced therefrom to define an enclosed portion of the first annular clearance; and liquid conduit means extending through the first stage housing adjacent the enclosed portion of the first annular clearance and through the second stage housing adjacent the second stage liquid ring for conveying liquid from the second stage liquid ring to the enclosed portion of the first annular clearance at substantially the pressure of the second stage liquid ring to substantially fill the enclosed portion with pressurized liquid, the annular seal member and the pressurized liquid in the enclosed portion cooperating to substantially prevent gas leakage through the enclosed portion from the high pressure side of the first stage to the low pressure side of the first stage, and also substantially preventing gas leakage through the first annular clearance from the second stage to the first stage.

8. In a two-stage liquid ring pump of the center head type, the pump including (1) first and second stages each having (a) a cylindrical housing, (b), a rotor eccentrically mounted for rotation in the housing, and (c) a port plate on the end of the housing adjacent the other stage, each port plate having an intake port and a discharge port, the first stage discharge port being connected to the second stage intake port, both rotors being mounted on a common shaft which extends through both of the port plates, each rotor including an annular hub and a plurality of radially extending circumferentially spaced blades, (2) a first annular clearance extending radially outward from the shaft between the first stage port plate and the adjacent end of the first stage rotor hub, and (3) a second annular clearance extending radially outward from the shaft between the second stage port plate and the adjacent end of the second stage rotor hub, improved gas sealing means comprising:

an annular seal member disposed in the first annular clearance, the annular seal member surrounding the shaft and being radially spaced therefrom to define an enclosed portion of the first annular clearance;

an interstage housing extending between the first and second stage port plates and surrounding the portion of the shaft between the rotor hubs;

a third annular clearance between the shaft and the interstage housing, the enclosed portion of the first annular clearance and the second and third annular clearances all communicating with one another; and means for supplying pressurized sealing liquid to the third annular clearance so that the pressurized liquid flows from the third clearance into both the enclosed portion of the first clearance and the second clearance to substantially fill the enclosed portion of the first clearance and the second and third clearances with pressurized sealing liquid, the pressure of the sealing liquid being at least equal to the final discharge pressure of the pump, the annular seal member and the pressurized liquid in the enclosed portion of the first clearance and in the second and third clearances cooperating to substantially prevent gas leakage through the enclosed portion from the high pressure side of the first stage to the low pressure side of the first stage and also substantially preventing gas leakage through the first annular clearance from the second stage to the first stage, and the flow of liquid into the second clearance substantially reducing leakage of gas through the second clearance from the high pressure side of the second stage.

9. The apparatus defined in claim 8 wherein the improved gas sealing means further comprises:

a second annular seal member disposed in the second annular clearance, the annular seal member surrounding the shaft and being radially spaced therefrom to define an enclosed portion of the second annular clearance which communicates with the third annular clearance.

* * * * *